US009022595B1

(12) United States Patent
Schilling et al.

(10) Patent No.: US 9,022,595 B1
(45) Date of Patent: May 5, 2015

(54) ILLUMINATED HALLOWEEN CANDY CONTAINER

(71) Applicants: Brandon S. Schilling, Elk Grove, CA (US); Gary D. Wood, Elk Grove, CA (US)

(72) Inventors: Brandon S. Schilling, Elk Grove, CA (US); Gary D. Wood, Elk Grove, CA (US)

( * ) Notice: Subject to any disclaimer, the term of this patent is extended or adjusted under 35 U.S.C. 154(b) by 218 days.

(21) Appl. No.: 13/669,797

(22) Filed: Nov. 6, 2012

(51) Int. Cl.
*F21V 33/00* (2006.01)
*A45C 15/06* (2006.01)

(52) U.S. Cl.
CPC ..... *F21V 33/0028* (2013.01); *F21V 33/0024* (2013.01); *A45C 15/06* (2013.01)

(58) Field of Classification Search
CPC .. A45C 15/06; F21V 33/0008; F21V 33/0028
USPC ..... 362/565, 154, 156, 155
See application file for complete search history.

(56) References Cited

U.S. PATENT DOCUMENTS

| | | | | |
|---|---|---|---|---|
| 4,802,071 | A | 1/1989 | Schuster | |
| 5,597,230 | A | 1/1997 | Newman | |
| 6,200,000 | B1 | 3/2001 | Burnidge | |
| 6,224,234 | B1 * | 5/2001 | Demmery | 362/156 |
| 6,789,932 | B2 * | 9/2004 | Healy | 362/565 |
| 6,869,199 | B1 | 3/2005 | Burnidge | |
| 7,147,342 | B2 * | 12/2006 | Burnidge | 362/156 |
| 2003/0086260 | A1 * | 5/2003 | Terrell et al. | 362/154 |
| 2010/0128588 | A1 * | 5/2010 | Shuman | 369/63 |

* cited by examiner

*Primary Examiner* — Robert May
(74) *Attorney, Agent, or Firm* — Crossley Patent Law

(57) ABSTRACT

An illuminated Halloween candy container that includes an open top, a rim, a handle, and a base, with a first container and a second container, the second container isomorphic with, but enlarged in respect to, the first container, the second container disposed surrounding and spaced apart from the first container, the second container joined to the first container by means of a rim plate disposed perimetrically around the rim, wherein a plurality of first, second, and third Light Emitting Diodes are included to respectively illuminate an ornamental pattern, floodlight for increased visibility, and illuminate a space between the first container and the second container, whereby the illuminated Halloween candy container is seen to glow, and a digital media player selectably plays recorded sounds, as desired.

10 Claims, 5 Drawing Sheets

ILLUMINATED HALLOWEEN CANDY CONTAINER

BACKGROUND OF THE INVENTION

Various types of illuminated Halloween candy containers are known in the prior art. However, what is needed is an illuminated Halloween candy container that includes an open top, a rim, a handle, and a base, with a first container and a second container, the second container isomorphic with, but enlarged in respect to, the first container, the second container disposed surrounding and spaced apart from the first container, the second container joined to the first container by means of a rim plate disposed perimetrically around the rim, wherein a plurality of first, second, and third Light Emitting Diodes are included to respectively illuminate an ornamental pattern, floodlight for increased visibility, and illuminate a space between the first container and the second container, whereby the illuminated Halloween candy container is seen to glow, and a digital media player selectably plays recorded sounds, as desired.

FIELD OF THE INVENTION

The present invention relates to an illuminated Halloween candy container, and more particularly, to an illuminated Halloween candy container that includes an open top, a rim, a handle, and a base, with a first container and a second container, the second container isomorphic with, but enlarged in respect to, the first container, the second container disposed surrounding and spaced apart from the first container, the second container joined to the first container by means of a rim plate disposed perimetrically around the rim, wherein a plurality of first, second, and third Light Emitting Diodes are included to respectively illuminate an ornamental pattern, floodlight for increased visibility, and illuminate a space between the first container and the second container, whereby the illuminated Halloween candy container is seen to glow, and a digital media player selectably plays recorded sounds, as desired.

SUMMARY OF THE INVENTION

The general purpose of the illuminated Halloween candy container, described subsequently in greater detail, is to provide an illuminated Halloween candy container which has many novel features that result in an illuminated Halloween candy container which is not anticipated, rendered obvious, suggested, or even implied by prior art, either alone or in combination thereof.

The present illuminated Halloween candy container includes an open top, a rim, a handle, and a base, and is envisioned for use during trick-or-treating. The concept, intents and purposes of the present device are applicable as a number of embodiments of the present invention. Therefore, a preferred embodiment encompassing all the features of the device is presented first in this summary. Alternate embodiments will then be presented to define the scope of the invention as realized in the present device.

A first container is surrounded by a translucent second container. The second container is isomorphic with, but enlarged in respect to, the first container. The second container is spaced-apart from the first container, and a space is therefore disposed between the first container and the second container. A rim plate is disposed atop the rim and joins the first container and the second container together.

The present illuminated Halloween candy container also includes a plurality of first Light Emitting Diodes, a plurality of second Light Emitting Diodes, and a plurality of third Light Emitting Diodes. The plurality of first Light Emitting Diodes is configured in an ornamental capacity, the plurality of second Light Emitting Diodes is configured to floodlight from the device for increased visibility when using the device, and the third plurality of Light Emitting Diodes is configured to illuminate the space between the first container and the second container. Considering that the second container is translucent, the plurality of third Light Emitting Diodes causes the second container to glow.

A digital media player is included, and recorded sounds are playable by means of a speaker disposed in the device. A control panel is included, which control panel is configured in circuit with the digital media player, the speaker, and each of the plurality of first, second, and third Light Emitting Diodes. The digital media player is alternately activated and deactivated by means of the control panel, and each of the plurality of first, second, and third Light Emitting Diodes are also activated and deactivated by means of the control panel.

Various configurations of the plurality of first Light Emitting Diodes are considered to accentuate the device. For example, a configuration of the plurality of first Light Emitting Diodes in the form of a face is presented. Configurations with the plurality of first Light Emitting Diodes further disposed in the handle and on the rim plate of the device are also presented. Configurations of the plurality of second Light Emitting Diodes include the plurality of second Light Emitting Diodes disposed on the base of the device, to floodlight the ground over which a trick-or-treater is walking.

The scope, intents, and purposes of the device are envisioned to include alternate shapes of the instant illuminated Halloween candy container. The preferred embodiment herein disclosed includes a form representing a jack-o-lantern. However other forms should be considered as part of the invention, such forms including the form of a bucket, the form of a head, a wolf's head, a monster's head, or other forms appropriate to embody and represent as a trick-or-treating candy container.

The device is considered with the digital media player included, but also with the digital media player excluded. The device is also considered with a single container only, with the plurality of third Light Emitting Diodes therefore omitted.

Thus has been broadly outlined the more important features of the present illuminated Halloween candy container so that the detailed description thereof that follows may be better understood and in order that the present contribution to the art may be better appreciated.

Objects of the present illuminated Halloween candy container, along with various novel features that characterize the invention are particularly pointed out in the claims forming a part of this disclosure. For better understanding of the illuminated Halloween candy container, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
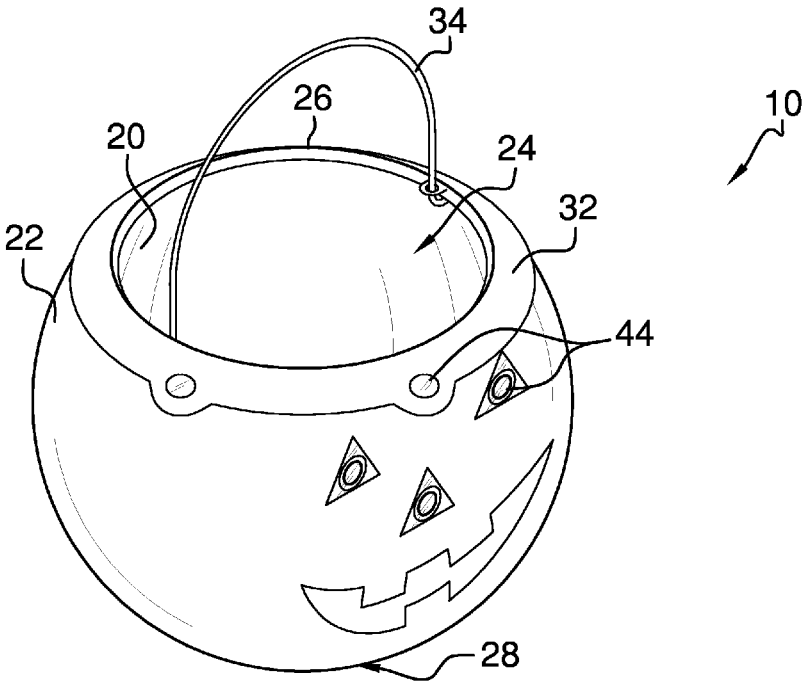
FIG. 1 is an isometric view.
Figure 2:
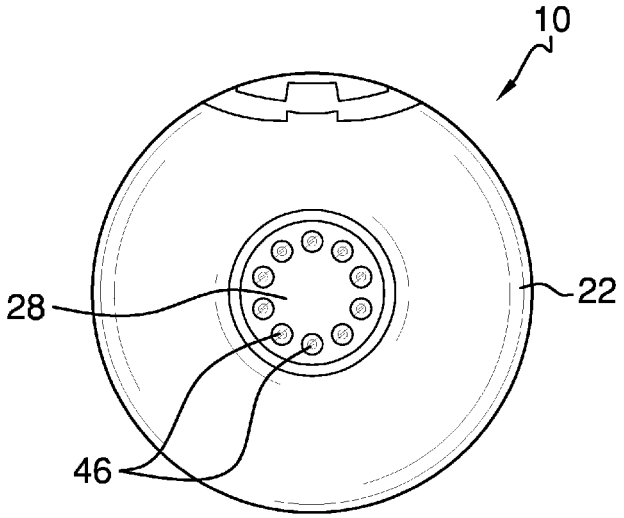
FIG. 2 is a bottom view.
Figure 3:
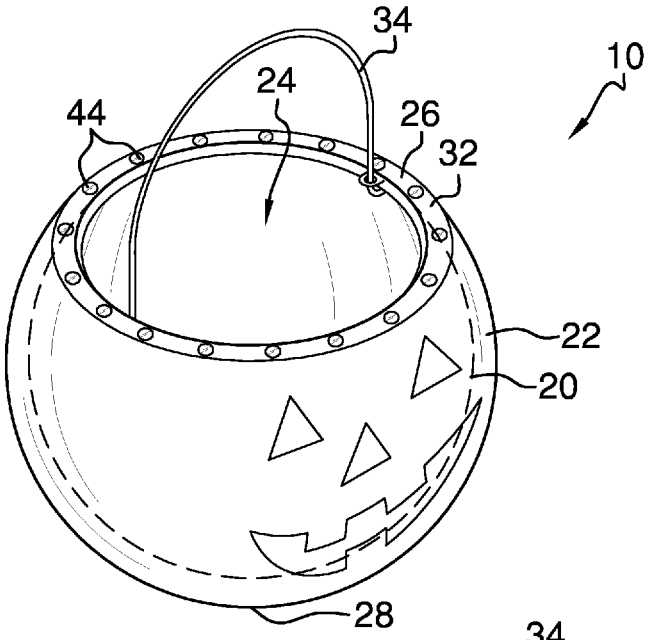
FIG. 3 is an isometric view with a plurality of first Light Emitting Diodes further disposed around a rim plate.
Figure 4:
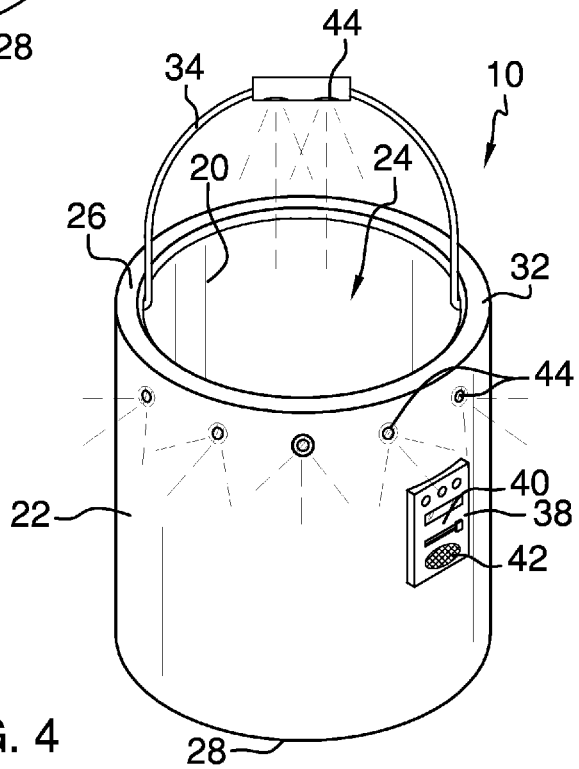
FIG. 4 is a isometric view of an alternate embodiment showing a bucket-shaped container.
Figure 5:
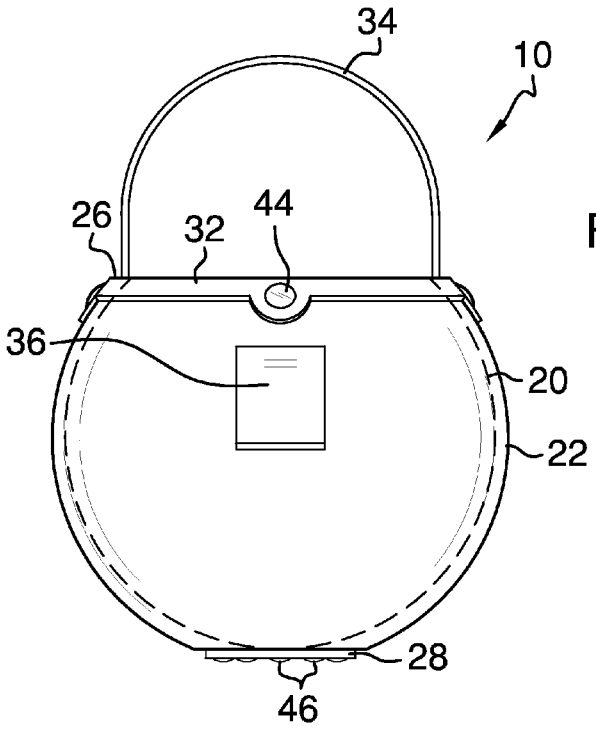
FIG. 5 is a back view.
Figure 6:
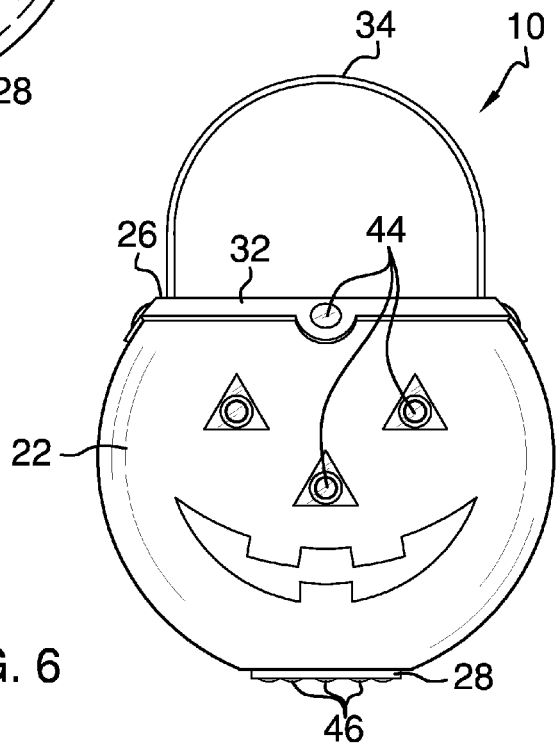
FIG. 6 is a front view.
Figure 7:
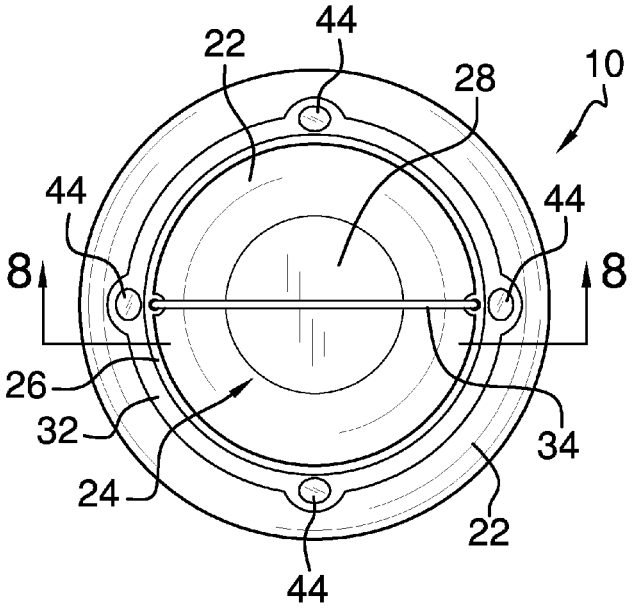
FIG. 7 is a top view.
Figure 8:
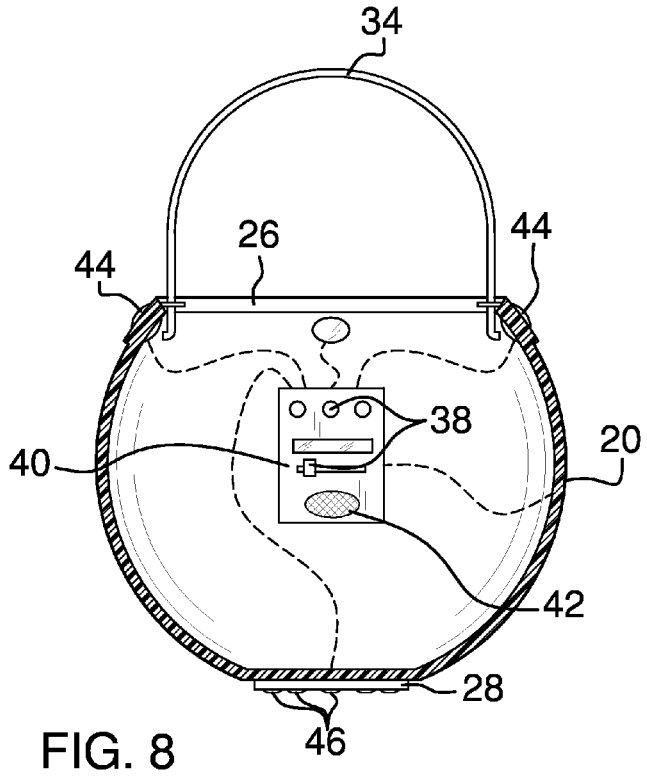
FIG. 8 is a cross-section view taken along the line 8-8 of FIG. 7.
Figure 9:
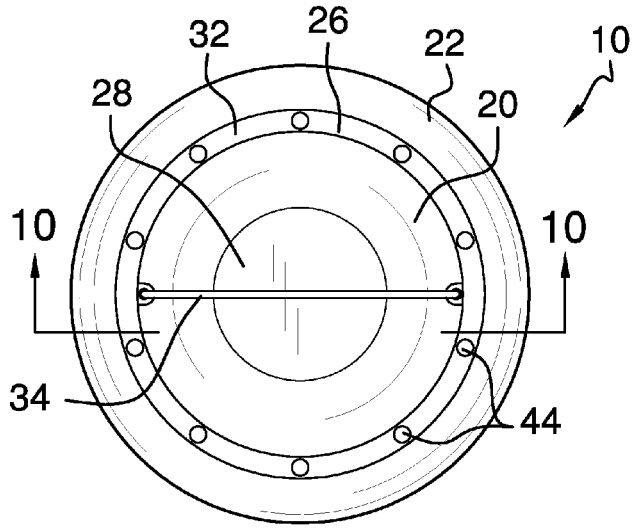
FIG. 9 is a top view illustrating an alternate embodiment with a plurality of first Light emitting Diodes disposed around a rim plate.
Figure 10:
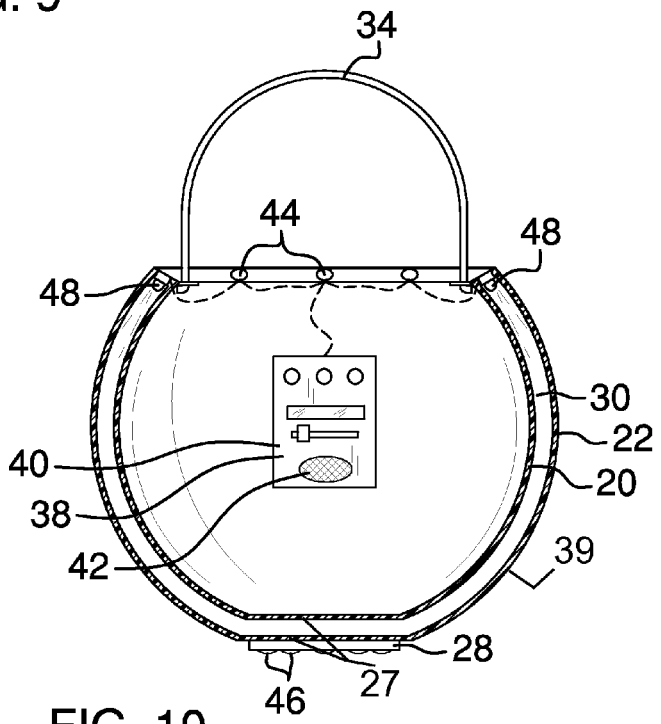
FIG. 10 is a cross-section view taken along the line 10-10 of FIG. 9.

With reference now to the drawings, and in particular FIGS. 1 through 10 thereof, example of the instant illuminated Halloween candy container employing the principles and concepts of the present illuminated Halloween candy container and generally designated by the reference number 10 will be described.

Referring to FIGS. 1 through 10 a preferred embodiment of the present illuminated Halloween candy container 10 is illustrated. With consideration of the concepts and application of the present device 10, a number of alternate embodiments are presented. Such alternate embodiments comprise the same innovation and improvements over the prior art. Therefore, the present illuminated Halloween candy container 10 should not be considered limited by the presentation of such alternate embodiments, but the concepts of the present illuminated Halloween candy container 10 considered across each alternate embodiment to better understand the concept and application of the device 10.

The illuminated Halloween candy container 10 includes a first container 20 and a second container 22. The first and second containers 20, 22 include an open top 24, a rim 26, and a bottom end 27. A base 28 is disposed directly adjacent and outside the bottom end 27 of the second container 22. The second container 22 is isomorphic with, but enlarged in respect to, the first container 20. The second container 22 is disposed around the first container 20. The second container 22 is translucent and is spaced-apart from the first container 20. A space 30 is therefore disposed between the first container 20 and the second container 22.

A rim plate 32 is perimetrically disposed around the rim 26 connecting the first container 20 and the second container 22. A moveable handle 34 is disposed on the illuminated Halloween candy container 10. A battery compartment 36 is disposed in the second container 22. A control panel 38 is disposed on an outer wall 39 of the second container 22. A digital media player 40 is disposed in the control panel 38, the digital media player 40 having a speaker 42. Recorded sounds are therefore playable with the digital media recorder 40. However, it should be noted that the device 10 is envisioned without the digital media player 40, and should not be considered limited by the inclusion of the digital media player 40 (see FIG. 1 and FIG. 5, for example).

A plurality of first Light Emitting Diodes 44 is disposed in the second container 22. The plurality of first Light Emitting Diodes 44 is a grouping of Light Emitting Diodes in an ornamental capacity, disposed on the second container 22, and additionally the rim plate 32, in a pattern. In the preferred embodiment herein specified, the pattern includes a face. The plurality of first Light Emitting Diodes 44 also includes Light Emitting Diodes disposed upon the handle 34 (see FIG. 4) and around the rim plate 32 (see FIG. 3).

A plurality of second Light Emitting Diodes 46 is disposed in the second container 22. The plurality of second Light Emitting Diodes is a grouping of Light Emitting Diodes that floodlight to increase visibility for a user of the device 10. The plurality of second Light Emitting Diodes 46 enables a user to use the device 10 without the need of additional illumination, such as an extant flashlight, for example, when walking in the dark trick-or-treating. In the preferred embodiment herein specified, the plurality of second Light Emitting Diodes 46 is attached to and protrude from the base 28. However, alternate placements should not be excluded from the scope and purposes of the device 10.

A plurality of third Light Emitting Diodes 48 is disposed upon the rim 26. This plurality of third Light Emitting Diodes 48 is configured to shine into the space 30 between the first container 20 and the translucent second container 22. The plurality of third Light Emitting Diodes therefore illuminates the second container 22, and the present device 10 is seen to glow.

The plurality of first 44, second 46, and third 48 Light Emitting Diodes are interconnected by a plurality of wiring 50, which plurality of wiring 50 further interconnects the control panel 38, the battery compartment 36, the speaker 42, and the digital media player 40. Thusly, each of the plurality of first 44, second 46, and third 48 Light Emitting Diodes may be activated and deactivated, as desired, by means of the control panel 38. The digital media player 40 may be activated or deactivated, as desired, by means of the control panel 38. Selectable settings are envisioned, wherein the control panel 38 enables selection between modes that illuminate different colored Light Emitting Diodes and the digital media player 38 selectably plays different sounds.

Each of the plurality of first 44, second 46, and third 48 Light Emitting Diodes are selectable between at least three modes, a first mode, a second mode, and a third mode. The first mode has activates each of the plurality of first 44, second 46, and third 48 Light Emitting Diodes to shine constantly. The second mode activates each of the plurality of first 44, second 46, and third 48 Light Emitting Diodes to flash at a specific interval. The third mode activates each of the plurality of first 44, second 46, and third 48 Light Emitting Diodes to flash at a specific interval, but the frequency of flashes is less than the frequency of flashes observed under the second mode and the duration of the lighted period is longer than that observed under the second mode.

The present illuminated Halloween candy container 10 is envisioned to resemble a jack-o-lantern (see FIGS. 1, 2, 3, & 5, for example). However, other general shapes should be considered as part of the general scope and purposes of the device 10. Such shapes include, but are not limited to, an illuminated Halloween candy container 10 resembling a head, a monster's head, a bucket (see FIG. 4), or other shapes suitable for use as a Halloween candy container.

An alternate embodiment is also disclosed wherein the illuminated Halloween candy container 10 has only the first container 20 (see FIG. 8), wherein the plurality of first 44 and second 46 Light Emitting Diodes are present, but the plurality of third 48 Light Emitting Diodes is absent. The other features of the device 10 are present, excepting the rim plate 32 which is not necessary in this embodiment.

What is claimed is:

1. An illuminated Halloween candy container comprising:

a first container;

a translucent second container, isomorphic and enlarged with respect to the first container, the second container disposed around the first container, the second container spaced-apart from the first container, each of the first and second containers having an open top, a rim, and a bottom end;

a base disposed directly adjacent and outside the bottom end of the second container;

a space disposed between the first container and the second container;

a rim plate perimetrically disposed around the rims connecting the first container and the second container;

a moveable handle;

a battery compartment;

a control panel disposed on the second container;

a plurality of first Light Emitting Diodes disposed in the second container;

a plurality of second Light Emitting Diodes attached to and protruding from the base;

a plurality of third Light Emitting Diodes configured to illuminate the space;

wherein the plurality of first Light Emitting Diodes is configured ornamentally, illuminating a pattern on the second container, the plurality of second Light Emitting Diodes floodlights for increased visibility, and the plurality of third Light Emitting Diodes illuminates the space between the first container and the second container whereby the second container glows.

2. The illuminated Halloween candy container of claim 1 further comprising a digital media player disposed on an outer wall of the second container, the digital media player having a speaker wherein a plurality of recorded sounds is playable.

3. The illuminated Halloween candy container of claim 2 wherein the digital media player records sounds.

4. The illuminated Halloween candy container of claim 1 wherein the plurality of first Light Emitting Diodes illuminates a pattern in a face.

5. The illuminated Halloween candy container of claim 4 wherein the plurality of first Light Emitting Diodes is further disposed around the rim.

6. The illuminated Halloween candy container of claim 1 wherein the plurality of first Light Emitting Diodes is further disposed in the handle.

7. The illuminated Halloween candy container of claim 1 wherein the illuminated Halloween candy container resembles a jack-o-lantern.

8. The illuminated Halloween candy container of claim 7 wherein the handle is attached to the first container.

9. The illuminated Halloween candy container of claim 1 wherein the illuminated Halloween candy container resembles a bucket.

10. An illuminated Halloween candy container comprising:

a first container;

a translucent second container, isomorphic and enlarged with respect to the first container, the second container disposed around the first container, the second container spaced-apart from the first container, each of the first and second containers having an open top, a rim and a bottom end;

a space disposed between the first container and the second container;

a base disposed directly adjacent and outside the bottom end of the second container;

a rim plate perimetrically disposed around the rims connecting the first container and the second container;

a moveable handle;

a battery compartment;

a plurality of first Light Emitting Diodes disposed in the second container, the rim plate, and the handle;

a plurality of second Light Emitting Diodes attached to and protruding from the base;

a plurality of third Light Emitting Diodes disposed upon the rim plate, each of the plurality of third Light emitting Diodes configured to shine into the space between the first container and the second container;

a control panel disposed on the second container, the control panel in circuit with each of the plurality of first, second, and third Light Emitting Diodes;

a digital media player disposed on an outer wall of the second container;

a speaker in circuit with the digital medial player;

a plurality of wiring connecting the battery compartment, the control panel, the digital media player, the speaker, and each of the plurality of first, second, and third Light Emitting Diodes in circuit;

wherein the plurality of first Light Emitting Diodes is configured ornamentally, illuminating a pattern on the second container, the second plurality of Light Emitting Diodes floodlights for increased visibility, and the plurality of third Light Emitting Diodes illuminates the space between the first container and the second container whereby the second container glows.

* * * * *